United States Patent [19]

Mougin

[11] 4,241,685

[45] Dec. 30, 1980

[54] SELF-STABILIZING FLOATING TOWER

[75] Inventor: Georges L. Mougin, Paris, France

[73] Assignee: ITI Ltd., Paris, France

[21] Appl. No.: 957,886

[22] Filed: Nov. 6, 1978

[30] Foreign Application Priority Data

Nov. 22, 1977 [FR] France ..... 77 34980

[51] Int. Cl.[3] ..... B63B 35/44; B63G 35/00

[52] U.S. Cl. ..... 114/264; 405/195; 405/205; 405/210

[58] Field of Search ..... 405/211, 210, 209, 208, 405/195, 200, 203, 205, 206, 207; 114/267, 264, 256

[56] References Cited

U.S. PATENT DOCUMENTS

| | | | |
|---|---|---|---|
| 1,718,006 | 6/1929 | Reno | 405/203 |
| 3,165,898 | 1/1965 | Elliott | 405/207 |
| 3,224,402 | 12/1965 | Kobus | 405/207 X |
| 3,824,943 | 7/1974 | Mo | 405/210 X |
| 3,914,947 | 10/1975 | Lamy | 405/207 |
| 3,998,061 | 12/1976 | Rederon et al. | 405/205 |
| 4,114,392 | 9/1978 | Lany | 405/207 |
| 4,155,323 | 5/1979 | Finsterwalder | 114/264 |

*Primary Examiner*—Dennis L. Taylor
*Attorney, Agent, or Firm*—George E. Kersey

[57] ABSTRACT

An offshore floating tower comprises two coaxial cylindrical enclosures (2 and 11) interconnected by continuous radial bulkheads (10) forming in the upper portion a ring of damping chambers (12) and in the lower portion a ring of buoyancy tanks (4) around a bell-shaped chamber (5) which is partially filled with air to produce pneumatic damping of vertical movement of the tower. The upper portion of the tower is separated from the lower portion by a horizontal slab (3). The upper portion of the internal enclosure is perforated in the vicinity of the horizontal slab.

8 Claims, 6 Drawing Figures

Fig. 1
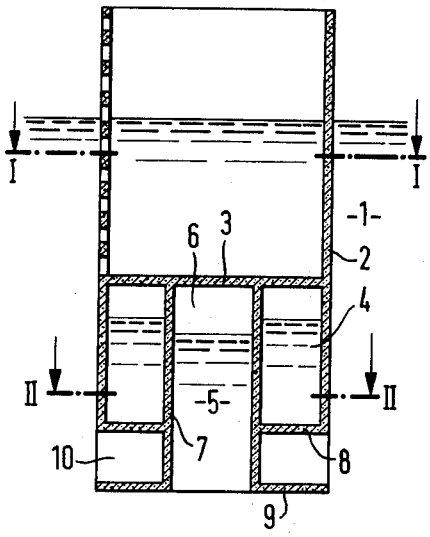
Fig. 2
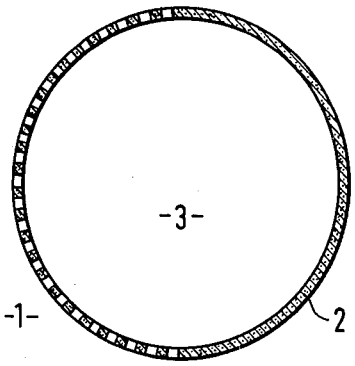
Fig. 3
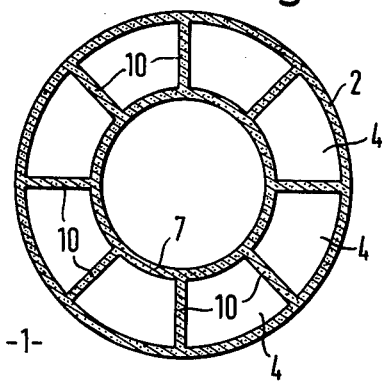
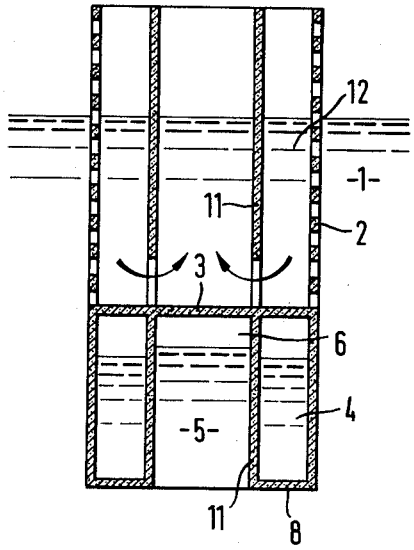
Fig. 4
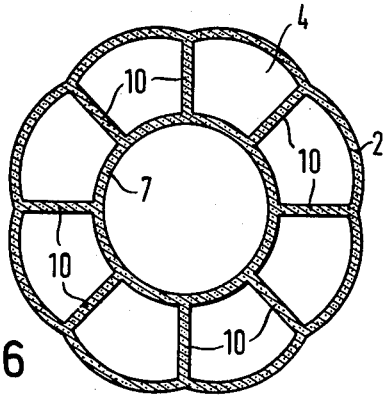
Fig. 6

SELF-STABILIZING FLOATING TOWER

The present invention relates to an offshore floating tower, whose vertical oscillatory movements have a lower amplitude than the vertical movement of the surface of the sea. This floating tower is self-stabilising.

The exploitation of the rich resources of the world's oceans requires the use in offshore waters of varied types of equipment which must be immobilized above the surface of the sea or in the sea at a fixed depth relative to the sea bed. Offshore petroleum operations give a good example of this type of requirement. The industrial use of tabular icebergs may also require the use of marine structures of the same type for the mooring, towing, protection and exploitation of the iceberg. As soon as the depth of water becomes significant, which is the case with tabular icebergs which are 200 meters thick, or as soon as the equipment must be capable of being moved, the use of a floating structure is mandatory.

Such a floating structure must remain relatively stationary in spite of the movement of the surface of the sea known as lapping or swell. A theoretical swell is characterised by a direction of propagation, a period, a wavelength, a propagation speed, and a height or depth which is the vertical distance between the crests and troughs, and which may exceed 10 meters. In other words, the height of the swell is the difference between the maximum instantaneous level of the water surface and the minimum level, relative to a stable body located in the water. The swell encountered in offshore waters is formed by the superposition of swells with various wavelengths propagating at different velocities, however, producing an oscillatory phenomenon known as "secular swell", calling for the taking of appropriate precautions when constructing floating towers. Nevertheless, although swells of more than 12 to 15 meters are rare and the highest recorded wave had a height of slightly more than 30 meters, it is necessary to allow for swells with greater amplitudes, for obvious safety reasons.

Thus, an object floating in offshore waters is caused to move by the movement of the surface of the sea, which communicates vertical and angular movements to it.

The amplitude of the vertical movement of a floating body is of the same order of magnitude as that of the swell, and may even be greater than the latter. The Archimedian upthrust on the floating body increases because the water surface is instantaneously at a level above the centre of flotation of the body floating in still water, and likewise this upthrust is reduced when the water level is instantaneously below the centre of flotation of the body floating in still water.

To limit the amplitude of the movement of the floating body caused by movement of the surface of the sea, the variations in the instantaneous water level must create variations in the Archimedian upthrust on the floating body representing only a small fraction of the total upthrust on the floating body which is equal to its weight. Consequently, the major part of the submerged volume of the floating body must be as far below the surface of the water as possible, and the horizontal cross-section at the centre of flotation must be as small as possible.

A known device, the so-called FROUDE pole, which has a diameter, and therefore a horizontal cross-section at the centre of flotation, which is small in relation to its length meets these criteria as the submerged volume is at some distance from the water surface. Floating structures or platforms used for underwater drilling operations also satisfy these criteria. The major part of their floating volumes is concentrated beneath the surface of the water and supported by substantially vertical cylinders which have a low volume in relation to the total displacement. It should be noted that in both these instances the diameter at the level of the flotation line is minimized so as to obtain a minimum cross-section.

The surrounding of tabular icebergs with devices for protecting them against erosion, the fixing of towing or mooring lines, and the attachment of thermal insulation panels may with advantage be carried out with the aid of cylindrical floating structures or floating towers which are regularly spaced and support lightweight deployable protective devices attached to ropes of metal or man-made materials or to textile straps. These floating towers are of sufficient diameter to permit the application of protective units in the form of vertical panels with cantilevered or catenary surfaces with horizontal generatrices, opposed in pairs and therefore stabilised.

Within the context of the state of the art as summarized above, preferred embodiments of the present invention provide an offshore floating tower capable of satisfying the following technical criteria, which are relative to the maximum amplitude of the swell or the maximum amplitude of the swell or the fluctuations in the level of the water surface:

the amplitude of the vertical movement of the tower is less than 20%, the height of the submerged portion of the tower does not exceed 150%, the height of the portion of the tower above the waterline may be reduced to 33%, the total height is less than 200%.

To this end, the present invention provides an offshore floating tower comprising a vertical cylindrical external enclosure divided by a horizontal slab into two open-ended half-cylinders: a lower half-cylinder comprising a ring of buoyancy tanks enclosing a bell-shaped chamber partially filled with air and producing partial pneumatic damping of vertical movement of the tower, and being ballasted to the required extent; and an upper half-cylinder open to the sea.

In accordance with a first embodiment of the invention the upper half-cylinder constitutes a single damper chamber. The surface of the upper half-cylinder is perforated in a regular pattern over an angle of 180°, whereas over an angle of 180° facing the surface to be protected, for example the vertical side surface of a tabular iceberg, the surface of the upper half-cylinder is unperforated.

In accordance with a second embodiment of the invention, the entire surface of the upper half-cylinder is perforated in a regular pattern. In this case, a vertical cylindrical internal enclosure coaxial with the vertical cylindrical external enclosure defines, in the upper half-cylinder, an annular damper chamber and, in the lower half-cylinder, the bulkhead separating the bell-shaped chamber from the ring of buoyancy tanks which are separated from the sea by a bulkhead consisting of the external cylindrical enclosure. The surface of the upper half-cylinder defined by the vertical cylindrical internal enclosure is perforated in the area of the horizontal slab so as to enable the interior of said internal enclosure to become filled with seawater. The perforations in the internal enclosure have a total surface area greater than the horizontal cross-section of the internal enclosure, to enable rapid equalisation of the water level inside the cylindrical internal enclosure. Thus the pressures of the seawater on the inside and outside of the upper half-cylinder defined by the internal enclosure are at least partially equalised, while the force of the waves is diminished by the annular damper chamber formed between the two enclosures.

It is possible to provide improved damping by fitting plane radial bulkheads extending over the full height of the tower between the cylindrical internal and external enclosures. A ring of damper chambers is thus formed in the upper portion of the tower, between the upper half-cylinders; in the lower portion of the tower, between the lower half-cylinders, these bulkheads constitute the side bulkheads of the ring of buoyancy tanks located between the lower half-cylinders. In addition, these vertical bulkheads may act as vertical stiffeners for the lower half-cylinder of the internal enclosure when the latter extends below the external enclosure with the object of retaining a sizeable ballast. Horizontal stiffeners with an external diameter equal to that of the external enclosure provide additional resistance to vertical movement of the floating tower. It should be noted that the use of horizontal disks has already been suggested to increase the vertical stability of buoys based on the FROUDE pole principle. However, these horizontal disks extended a considerable distance beyond the body of the buoy, unlike the horizontal stiffeners of the floating towers in accordance with the present invention.

A floating tower in accordance with the invention may be readily manufactured using the "sliding shuttering" technique. The cross-section of a tower is the same over all its height; only the horizontal slabs close off the inside of the tower, either partially (floor of the buoyancy tanks) or totally (roof of the buoyancy tanks). The external enclosure may be a straight cylinder whose base is circular or in the shape of a rose, i.e. formed of projecting circular segments with a diameter less than that of the circumscribed cylinder of the vertical plane bulkheads.

There are at least eight buoyancy tanks, and they are at least partially filled with air. They may be partially filled with seawater for regulation of the immersion depth and trim of the floating tower. Internal bulkheads are provided to slow down the movement of seawater inside the tank, and the air contained in the tanks may be pressurized to partially counterbalance the stresses due to the external pressure of the seawater.

Seawater is normally used as ballast, but the fuel for the propulsion unit may be used as ballast in certain of the tanks.

At the centre of the ring of buoyancy tanks, the internal enclosure is closed off by the slab which forms the roof of said tank, defining a bell-shaped chamber, the upper portion of which is filled with air and the lower portion of which is filled with water. The trapped air is naturally at a pressure corresponding to its depth of immersion, i.e. at a pressure corresponding to the weight of the column of water between the instantaneous level of the sea and the interface between the seawater and the air inside the bell-shaped chamber.

When the swell causes an instantaneous increase in the level of the water in which the tower is floating relative to the level in calm water, the height of the column of water and therefore the pressure increase, decreasing the volume of air trapped in the bell-shaped chamber. This reduction in volume and therefore in buoyancy compensates the increase in buoyancy resulting from the increase in the submerged volume as a result of the instantaneous increase in the water level. Thus although the tower is submerged to a greater extent, it is subjected to an Archimedian upthrust which is substantially constant, and so has no tendency to rise.

Likewise, when the swell causes an instantaneous decrease in the water level relative to the level in calm water, the decrease in the head of water reduces the pressure and so increases the volume of the air in the bell-shaped chamber to increase the buoyancy to compensate the reduction of the submerged volume. Although submerged to a lesser extent, the tower is subjected to an overall Archimedian upthrust which is substantially constant, and has no tendency to sink.

In order to partially cancel one another out, the variation in the volume of air contained in the bell-shaped chamber and the variation in the submerged volume at the centre of flotation must involve volumes of the same order of magnitude. To this end, the height of the air within the bell is determined so that its variation expressed relative to the corresponding variation in the instantaneous water level causing it is approximately equal to the ratio of the horizontal cross-section at the centre of flotation of the tower to the horizontal cross-section of the interface between the seawater and the air inside the bell-shaped chamber.

A floating tower in accordance with the invention may be fitted with additional superstructure above the water, as appropriate to its function. Such superstructures are known per se, and do not form part of the invention.

The invention will now be described in more detail, by way of example only.

In the accompanying drawings, which are given by way of non-limiting example only:

FIG. 1 is a vertical cross-section taken on a diameter of a floating tower in accordance with the invention;

FIG. 2 is a horizontal cross-section through the floating tower shown in FIG. 1, above the horizontal slab;

FIG. 3 is a horizontal cross-section through the floating tower shown in FIG. 1, underneath the horizontal slab;

FIG. 4 is a vertical cross-section taken on a diameter of another embodiment of the invention, which is shown in perspective view in FIG. 5;

FIG. 6 is a horizontal cross-section through a third embodiment of the invention.

Figure 5:
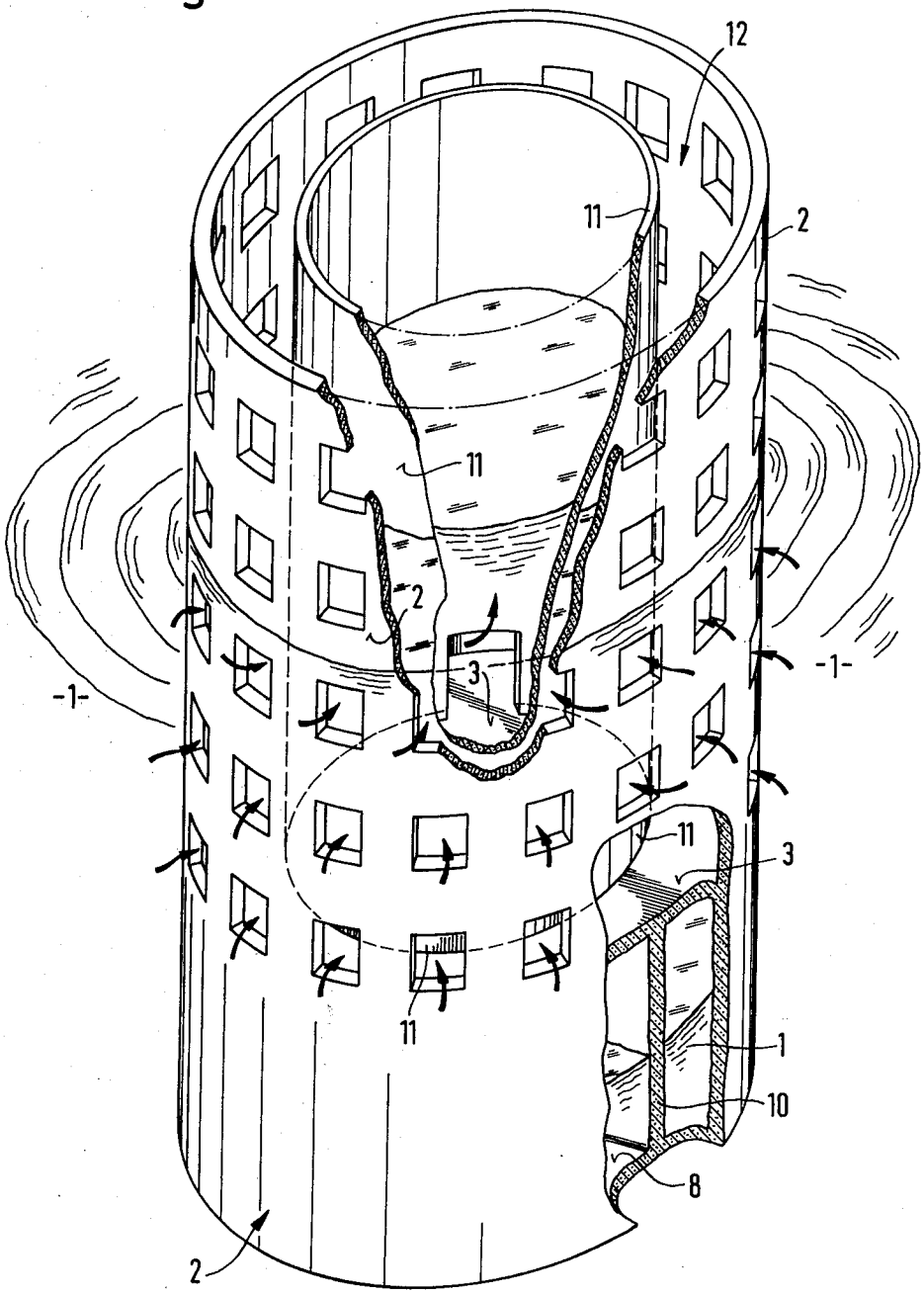

A list of the reference numerals used in the following description, with the associated items, will be found after the description.

FIG. 1 is a vertical cross-section taken on the diameter of a floating tower in accordance with a first embodiment of the invention, the tower floating in the sea (1). The floating tower comprises a vertical cylindrical external enclosure (2) divided by a horizontal slab (3) into two open-ended half-cylinders. The lower half-cylinder comprises a ring of buoyancy tanks (4), of which there at least eight. These tanks (4) enclose a bell-shaped chamber (5) which is partially filled with air (6). The buoyancy tanks (4) are at least partially filled with seawater to stabilise the floating tower. The bell-shaped chamber (5) produces partial pneumatic damping of vertical movement of the floating tower. The buoyancy tanks (4) are defined by the horizontal slab (3) forming their roof and an annular slab (8) forming their floor, these slabs forming part of the external enclosure (2), and by an internal cylindrical bulkhead (7). This bulkhead (7) extends below the external enclosure (2) and has an annular flange (9) forming a horizontal stiffener with an external diameter equal to that of the cylindrical external enclosure (2). The vertical bulkheads (10) separating the buoyancy tanks (4) from one another in the lateral direction extend below said buoyancy tanks between the annular slab (8) forming the floor thereof and the annular flange (9) forming a horizontal stiffener. The bulkheads (10) therefore constitute a vertical stiffener for the cylindrical bulkhead (7) which retains seawater acting as ballast. The upper half-cylinder corresponding to the upper portion of the external enclosure (2) is perforated in a regular pattern over an angle of 180° and has an unperforated surface over an angle of 180°. The perforations are as disclosed by JALAN in U.S. Pat. No. 3,383,869 filed Jan. 18, 1965 and granted May 21, 1968. The interior of the upper half-cylinder thus forms a single damper chamber.

FIG. 2 is a horizontal cross-section on the line I—I of the floating tower shown in FIG. 1, showing the position of the perforations.

FIG. 3 is a horizontal cross-section on the line II—II of the floating tower shown in FIG. 1. The buoyancy tanks (4) are defined by the external enclosure (2), the cylindrical bulkhead (7) and the vertical bulkheads (10).

FIG. 4 is a vertical cross-section through another embodiment of a floating tower in accordance with the invention. The vertical cylindrical external enclosure (2) is divided by a horizontal slab (3) into two open-ended half-cylinders. A vertical internal enclosure (11) coaxial with the vertical cylindrical external enclosure (2) defines an annular damper chamber (12) in the upper half-cylinder and, in the lower half-cylinder, constitutes the bulkhead separating the bell-shaped chamber (5) from the buoyancy tanks (4).

As shown in FIG. 5, which is a partially cutaway perspective view of a floating tower in accordance with the embodiment shown in FIG. 4, seawater can enter the annular damper chamber (2) via the rectangular perforations in the external enclosure (2). These perforations may also be circular. When the surface of the sea moves, the wave is partially broken by the unperforated portions of the external enclosure (2), while part of the wave enters the annular damper chamber (12) to be broken against the internal enclosure (11). The internal enclosure (11) is perforated in the vicinity of the horizontal slab (3) to provide for rapid equalisation of the water level inside the internal enclosure (11). The total area of these perforations is greater than the horizontal cross-section of the internal enclosure (11). As a result, the pressure exerted on the internal enclosure (11) from the annular damper chamber (12) is partially equalised by a counterpressure exerted from inside the floating tower. The lower part of the floating tower comprises a ring of buoyancy tanks (4) at least partially filled with seawater (1). These tanks (4) are separated from one another by vertical bulkheads (10) connecting together the horizontal slab (3) forming the roof of said tanks (4) and the annular slab (8) forming their floor.

FIG. 6 is a horizontal cross-section through a floating tower in accordance with the invention. The special feature of this cross-section is an external enclosure (2) which is not circular, as is that in FIG. 3. Between adjacent vertical bulkheads (10), the external enclosure (2) has a radius which is less than the radius of the circumscribed circle of the bulkheads (10). This special arrangement results in improved resistance to the loads generated by the movement of the surface of the sea (1).

It is a remarkable feature that it is possible to divide up the annular damper chamber (12) by means of radial vertical bulkheads. This produces a set of plane bulkheads between the internal enclosure (11) and the external enclosure (2) over the full height of the floating tower. This being the case, the horizontal cross-section of the tower is similar to the horizontal cross-section in the configuration shown in FIGS. 3 and 6. The vertical cross-section is then similar to that shown in FIG. 4.

A floating tower of the type described herein above is constructed of concrete using the "sliding shuttering" technique.

| LIST OF REFERENCE NUMERALS | |
|---|---|
| 1 | sea |
| 2 | external enclosure |
| 3 | horizontal slab |
| 4 | buoyancy tank |
| 5 | bell-shaped chamber |
| 6 | air |
| 7 | cylindrical bulkhead |
| 8 | annular slab |
| 9 | annular flange |
| 10 | vertical bulkhead |
| 11 | internal enclosure |
| 12 | annular damper chamber |

I claim:

1. An offshore floating tower comprising a vertical cylindrical external enclosure divided by a horizontal slab into two open-ended half-cylinders;

a lower half-cylinder comprising a ring of buoyancy tanks enclosing a bell-shaped chamber partially filled with air and producing partially pneumatic damping movement of the tower, and being ballasted to the required extent; and an upper half-cylinder open to the sea with its entire surface comprising a regular pattern of perforations;

said tower including a vertical cylindrical internal enclosure coaxial with the vertical cylindrical exterior enclosure, constituted in the upper half-cylinder, an annular damper chamber and, in the lower half-cylinder, a bulkhead separating the bell-shaped chamber from the ring of buoyancy tanks which are separated from the sea by a bulkhead consisting of the external cylindrical enclosure.

2. An offshore floating tower according to claim 1, wherein the surface of the upper half-cylinder comprises a regular pattern of perforations extending over an angle of 180°, said upper half-cylinder forming a single damper chamber.

3. An offshore floating tower according to claim 1, wherein the entire surface of the upper half-cylinder comprises a regular pattern of perforations.

4. An offshore floating tower according to claim 1, wherein the surface of the upper half-cylinder defined by the vertical cylindrical internal enclosure is perforated in the area of the horizontal slab so as to cause the interior of said internal enclosure to become filled with seawater.

5. An offshore floating tower according to claim 4, wherein the perforations in the internal enclosures have a total surface area greater than the horizontal cross-section of the internal enclosure.

6. An offshore floating tower according to claim 5, including plane radial bulkheads disposed between the cylindrical internal and external enclosures and extending over the full height of the tower, said plane radial bulkheads defining, between the two upper half-cylinders, a ring of damper chambers which form side bulkheads of the ring of buoyancy tanks between the two lower half-cylinders.

7. An offshore floating tower according to claim 6, wherein the internal cylindrical enclosure extends below the external cylindrical enclosure and the vertical radial bulkheads acting as vertical stiffeners and retaining horizontal stiffeners with an external diameter equal to that of the external cylindrical enclosures.

8. An offshore floating tower according to claim 1, wherein the tower is constructed of concrete using the "sliding shuttering" technique.

* * * * *